United States Patent [19]

Polad et al.

[11] 4,378,733

[45] Apr. 5, 1983

[54] EMBOSSING DRIVE MECHANISM FOR AN AUTOMATIC EMBOSSING SYSTEM

[75] Inventors: Michael D. Polad, Mendota; Leroy E. Gerlach, Bloomington; Edward R. Gabel, Eden Prairie; Robert H. Schmidt; Glenn H. Heiller, both of Minnetonka, all of Minn.

[73] Assignee: Data Card Corporation, Minnetonka, Minn.

[21] Appl. No.: 198,486

[22] Filed: Oct. 20, 1980

[51] Int. Cl.[3] ..... B31F 1/07

[52] U.S. Cl. ..... 101/18; 101/29

[58] Field of Search ..... 101/18, 29, 93.30, 93.31; 400/129-132, 134, 134.2, 134.3

[56] References Cited

U.S. PATENT DOCUMENTS

| | | | |
|---|---|---|---|
| 489,073 | 1/1893 | Edwards . | |
| 2,911,086 | 8/1954 | Martindell . | |
| 3,146,471 | 2/1961 | Edmondson . | |
| 3,543,589 | 12/1967 | Loughran, Jr. . | |
| 3,648,816 | 3/1972 | Marinoff . | |
| 3,673,956 | 7/1972 | Huber et al. | 101/93.31 |
| 3,726,380 | 4/1973 | Beers et al. . | |
| 3,753,482 | 8/1973 | Brown et al. . | |
| 3,861,299 | 1/1975 | Drillick | 101/18 |
| 4,057,011 | 11/1977 | Tramposch et al. . | |
| 4,088,216 | 5/1978 | La Manna et al. | 101/18 X |
| 4,091,910 | 5/1978 | Bolton et al. | 101/18 X |
| 4,182,239 | 1/1980 | Timmins et al. | 101/29 X |

FOREIGN PATENT DOCUMENTS 1576651 10/1980 United Kingdom .

*Primary Examiner*—Edward M. Coven
*Attorney, Agent, or Firm*—Staas & Halsey

[57] ABSTRACT

An automatic embossing system, having punch and die wheels respectively carrying axially aligned associated punches and dies disposed about their perimeters, is provided with an improved drive mechanism for actuation of a desired punch and die pair to emboss a card disposed therebetween. The drive mechanism includes a pair of bail arms driven in continuous oscillation by a uniquely shaped cam, each bail arm carrying an adjustably mounted solenoid actuated interposer. By firing the solenoid, the interposers are disposed between driving surfaces of the respectively associated bail arms so as to engage the driving ends of the punch and die pair. The interposer structures are independently adjustable, thereby permitting ease of adjustment of the height of embossed characters formed in the card.

18 Claims, 6 Drawing Figures

EMBOSSING DRIVE MECHANISM FOR AN AUTOMATIC EMBOSSING SYSTEM

BACKGROUND OF THE INVENTION

1. Field of the Invention

The present invention relates to a mechanism for driving an embossing apparatus in an automatic embossing system.

2. Description of the Prior Art

There exist a number of embossing systems for automatic, high-speed embossing of credit cards. One such system is disclosed in U.S. Pat. No. 4,088,216 to LaManna, et al., assigned to the assignee of the present invention.

The system of U.S. Pat. No. 4,088,216 employs a pair of embossing wheels fixedly mounted on a common shaft for rotation, and carrying about their respective peripheries punch and die pairs for all characters available for embossing. The embossing wheels are selectively rotated to position a desired embossing character punch and die pair at an embossing station. The actuating mechanism for the punch and die pair includes a pair of pivotally mounted bail arms continuously driven in an oscillating manner by a complex linkage driven by an eccentric. Each revolution of the eccentric defines an embossing cycle. The bail arms do not directly engage the punch and die pairs but, even when pivoted to a forward position, remain displaced from the engaging ends of the associated punch and die. This permits free rotation of the embossing wheels while the bail arms, as well, are continuously oscillating in the manner indicated above. When the embossing wheels have been rotated to position the punch and die pair of a desired character at the embossing station, at the beginning of the next embossing cycle, interposers are disposed intermediate the ends of the engaging surfaces of the bail arms and the associated engaging ends of the punch and die, thereby to transmit the embossing force from the bail arms to the respective punch and die, causing them to engage and thereby emboss the card.

While the above system operates satisfactorily, the complexity of the linkage mechanism results in a greater chance of breakdown and increases the problem of adjusting the linkage to obtain the proper embossing drive motion. Further, where the element to be embossed has higher structural density or integrity than the conventional plastic credit card, such as a metal identification tag or the like, the increased force required for actuating the punch and die pair imposes additional strength requirements on the linkage mechanism.

SUMMARY OF THE INVENTION

Accordingly, it is an object of this invention to provide a simplified embossing drive mechanism having fewer parts and thus, less opportunity for malfunction.

Another object of the invention is to provide a drive mechanism which may be readily adjusted to vary the position of the punch and die pairs and their extent of travel, relative to the plane of a card or other element to be embossed, and thus the height of the embossed characters.

A further object of the invention is to provide, for use in automatic embossing systems, a drive mechanism of increased strength and thus one capable of providing increased driving force to the punch and die pairs, relative to prior art systems.

The drive mechanism of the present invention may be employed with a rotatable embossing wheel arrangement of the type disclosed in the above-referenced U.S. Pat. No. 4,088,216 and similarly may include a pair of pivotally mounted bail arms which are driven in a continuous, oscillating motion. As distinguished from that prior art system, however, the bail arms of the present invention are driven directly by a uniquely shaped cam. The cam thus replaces the combination of the complex linkage mechanism and eccentric employed for driving the bail arms as shown in the above-referenced patent. The drive mechanism of the present invention is of simplified construction and lower cost, provides for simplified operation, and, once properly mounted in driving position, requires no further adjustments such as those which are occasionally required with the linkage-drive arrangement. Moreover, the simplified structure of the present drive mechanism permits a reinforced and increased strength design which can transmit higher embossing forces than can readily be achieved with prior art systems.

The apparatus of the present invention also includes interposer structures, which in the present invention are mounted on top of the respective bail arms, and thus move with the bail arms. The interposers function as in the prior art system. However, the improved mounting arrangement of the interposers of the present invention permits convenient adjustment of the relative position of each interposer with respect to its bail arm, to take into account a particular card thickness and so that the embossing height on the card may be varied.

These objects together with other objects and advantages, which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
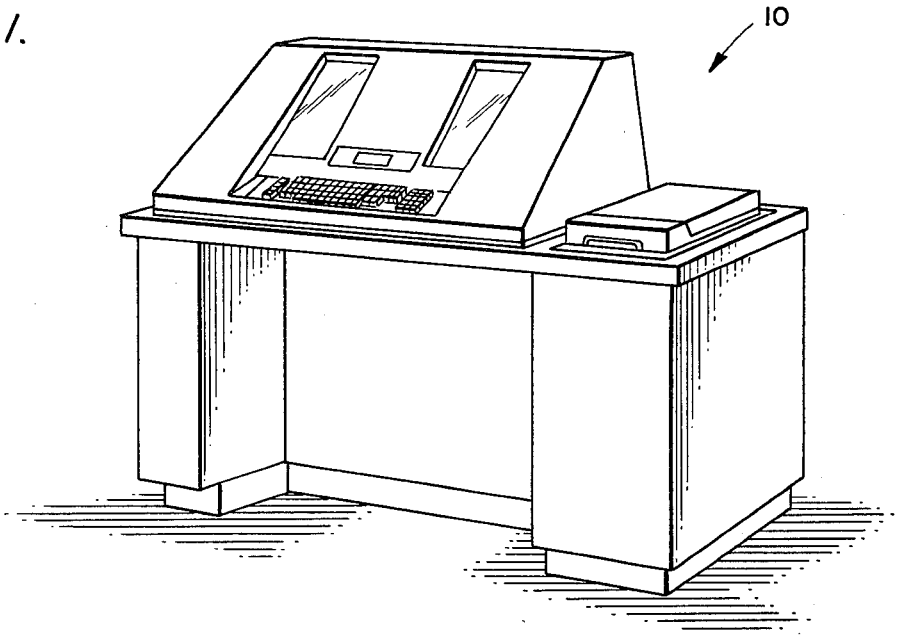
FIG. 1 is a perspective view of an overall automatic embossing system, similar to that of U.S. Pat. No. 4,088,216, in which the drive mechanism of the present invention may be employed.

FIG. 1 is a perspective view of an embossing system 10 in which the drive mechanism of the present invention may be employed. The electronic control system and the card transport apparatus are essentially the same as that disclosed in U.S. Pat. No. 4,088,216 to LaManna, et al., the disclosure of which is hereby incorporated by reference. As noted above, an embossing system employing the embossing drive mechanism and related apparatus in accordance with the present invention may be employed to emboss any document made of suitable plasticly deformable material such as conventional plastic credit cards, metal identification plates, or the like. In this regard, reference hereinafter to "card" shall be understood to include any such card-like element of any material suitable for embossing.

Figure 2:
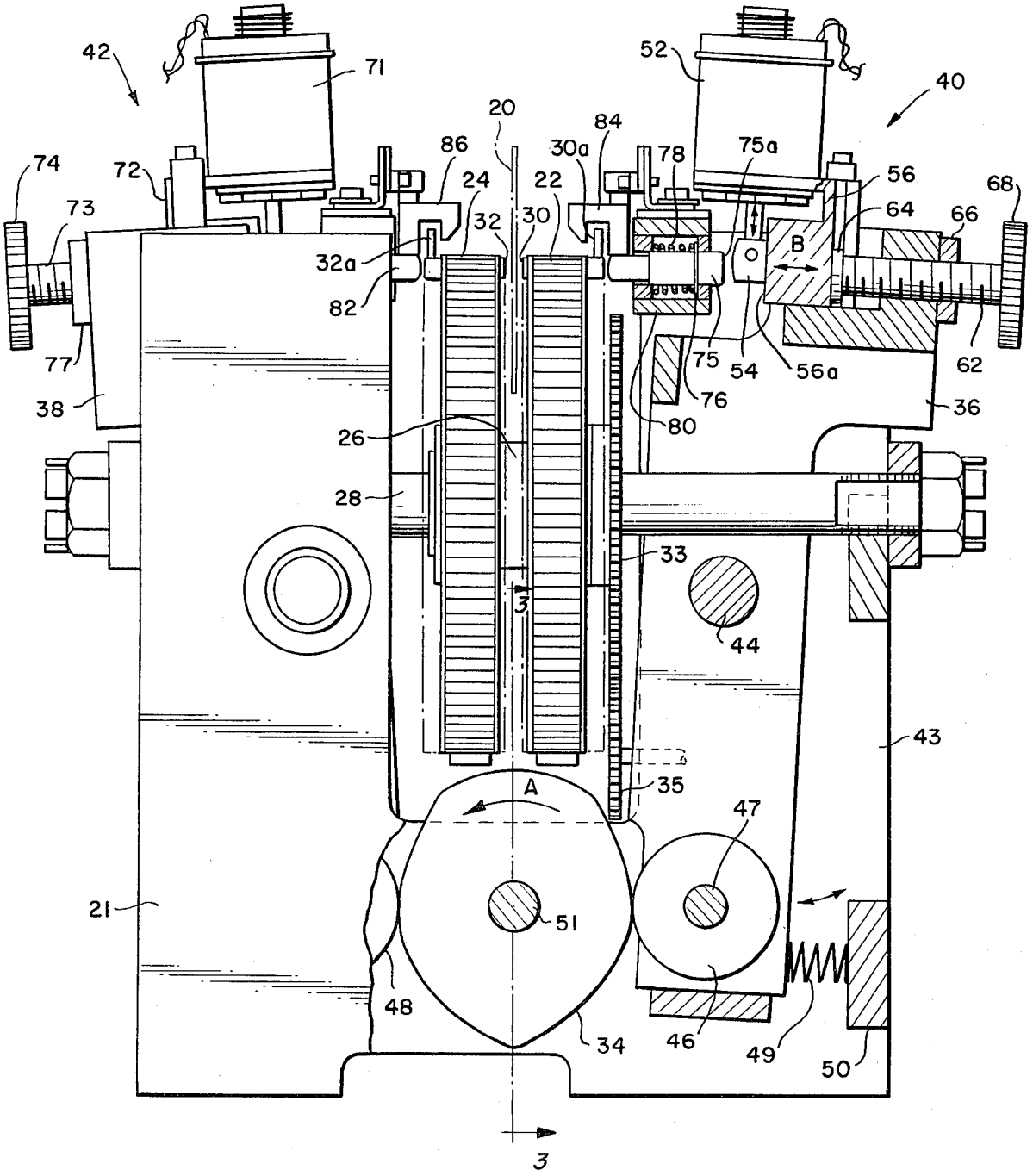
FIG. 2 is a side elevational view, partly in section, showing the embossing apparatus and the embossing drive mechanism of the present invention.

FIG. 2 is a side view of an embossing apparatus employing the embossing drive mechanism of the present invention, for embossing a card 20.

The embossing apparatus has a housing 21, and includes a punch wheel 22 and a die wheel 24. The wheels 22 and 24 have a common integral hub portion 26 which joins the wheels 22 and 24 and provides for mounting of the wheels for rotation on a wheel shaft 28. The punch wheel 22 carries a plurality of punches 30 and the die wheel 24 carries a plurality of corresponding dies 32. The wheels 22 and 24 are selectively rotated by a motor (not shown) through a gear train of gears 33 and 35 to position a selected punch 30 and die 32, in accordance with data inputted to the automatic embossing system, at the embossing station generally defined at the top, or uppermost position of the wheels 22 and 24. The system for rotating the wheels 22 and 24 is described in U.S. Pat. No. 4,088,216.

The embossing drive mechanism includes a drive cam 34 and a pair of bail arms 36 and 38 having mounted thereon interposer structures 40 and 42, respectively. Since the bail arms 36 and 38 and the interposer structures 40 and 42 are identical, only the bail arm 36 and interposer structure 40 will be described in detail. In particular, as seen in FIG. 2, a portion of the housing 21 has been removed to reveal the bail arm 36 and its associated components including a rigid support 43 on which are mounted the embossing apparatus and the associated components of the drive mechanism, including bail arms 36 and 38, as well as the cam 34, as hereinafter described. The bail arm 36 is pivotally mounted on a shaft 44, in turn fixed to the support 43, and carries a cam follower 46 rotatably mounted by a shaft 47 to the lower extremity of the bail arm 36. As seen in partial section, the bail arm 38 includes a corresponding cam follower 48. A bias spring 49 is secured at one end to a mounting bracket 50 on the support 43 and at its other end to the lower extremity of the bail arm 36 adjacent to the cam follower 46, to bias the latter against the cam 34.

Figure 3:
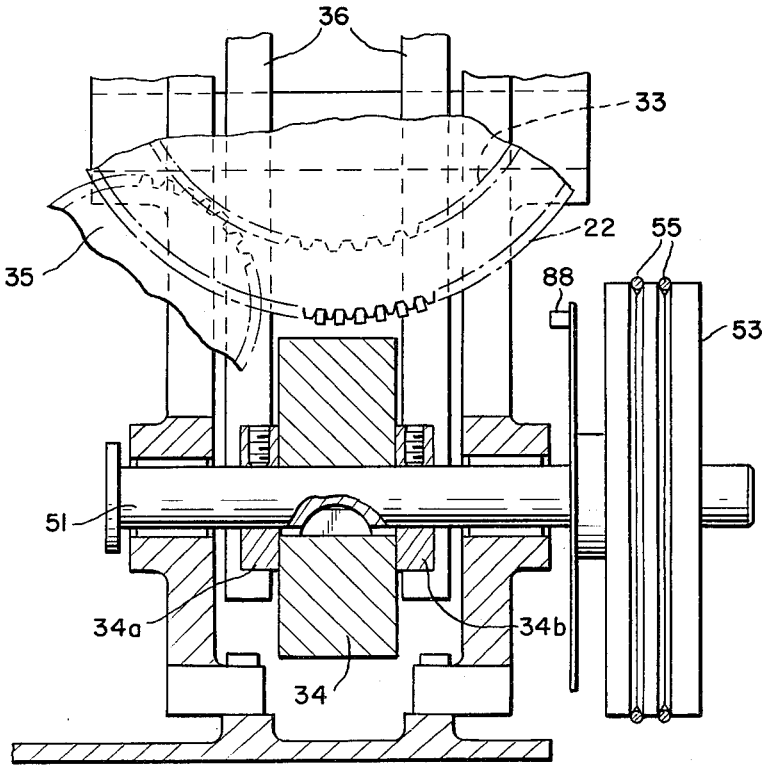
FIG. 3 is a cross-sectional view taken along lines 3—3 in FIG. 2.

Referring to FIG. 3, the cam 34 is fixedly secured by mounting blocks **34*a* and 34*b* to a shaft 51 rotatably mounted in the support 43 and which is driven in constant rotation through a pulley 53 and belts 55 by a motor (not shown) in the direction indicated by arrow A in FIG. 2. As seen in FIG. 2, rotation of the drive cam 34 causes the cam follower 46, in conjunction with the bias force of the spring 49, to drive the bail arm 36 in continuous oscillation about its pivot shaft 44**.

Figure 4:
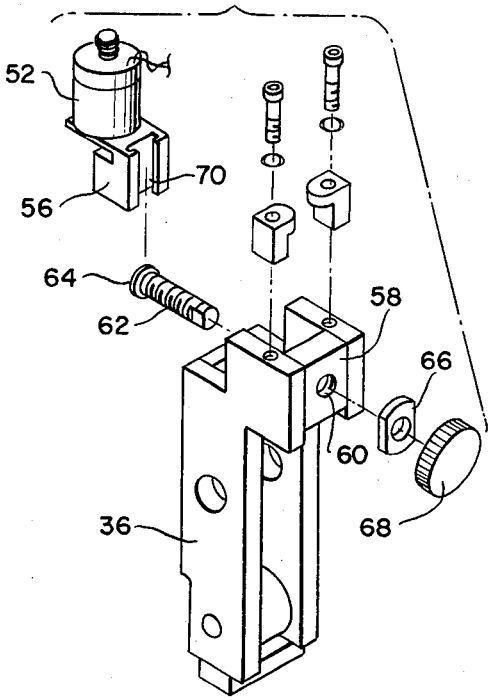
FIG. 4 is an exploded perspective view of the bail arm and interposer mounting arrangement.

The interposer structure 40 includes an interposer solenoid 52 carrying an interposer tip 54 on its moveable core and an adjustable interposer bracket 56 adjustably mounted on the top of the bail arm 36. The assembly of interposer structure 40 and its mounting on bail arm 36 is best illustrated in FIG. 4. Bail arm 36 has a top rear mounting wall 58 having a threaded hole 60 through which a bolt 62, having a head 64, is threaded. A lock nut 66 is threaded on bolt 62 up against the wall 58 to lock the bolt 62 in place. A thumb wheel 68 is mounted on the end of the bolt 62 and is secured, for example, by a set screw (not shown). Rotation of the thumb wheel 68 alternately in clockwise and counterclockwise directions permits selective adjustment of the extent to which the head 64 of the bolt 62 projects inwardly of the mounting wall 58 in the orientation of the parts as shown in FIG. 4, and thus in the left or right axial directions indicated by the doubleheaded arrow B in FIG. 2. Interposer bracket 56 is configured to define a channel 70 for slideably receiving and thereby engaging the bolt head 64. Thus, as best seen in FIG. 2, rotation of the thumb wheel 68 operates through the bolt 62 to move the bracket 56 inwardly or outwardly relative to the mounting wall 58 as indicated by the double arrow B. Similarly, the interposer structure 42, mounted on the bail arm 38, includes a solenoid 71 adjustably mounted on the bail arm 38 by a corresponding bracket 72 having associated, corresponding mounting elements including a threaded bolt 73 carrying a thumb wheel 74 and a lock nut 77. As will be described, the adjustment of the positions of the interposer structures 40 and 42 relative to their corresponding bail arms 36 and 38 permits corresponding adjustment of the location and extent of engagement of the punch and die pairs relative to each other, to control the embossing height, and relative to the nominal location of a card 20 positioned therebetween.

The remaining elements of the embossing apparatus include an intermediate driver 75 which is engaged by the interposer tip 54 when an embossing operation is to occur. The intermediate driver 75 includes a flange 76 and carries a bias spring 78 about its shank portion, enclosed within the housing 80 mounted on the upper, inner extremity of the support 43. Bias spring 78 maintains the intermediate driver 75 in a normally retracted position as shown in FIG. 2. The left extremity of the intermediate driver 75 extends through the housing 80 in alignment with the end of a punch 30 currently positioned at the embossing station and carries a retractor 84. The retractor 84, under the bias of the spring 78 engages a flange **30*a* on the punch 30, to retract the punch 30 after embossing has occurred. Correspondingly, an intermediate driver 82 associated with the bail arm 38 is positioned to engage the driving end of the associated die 32 and has a retractor 86 for engaging flange 32*a* of die 32**.

In operation, as disclosed more fully in the above-referenced patent, the punch and die wheels 22 and 24 are rotated or indexed, as required, to position a desired punch 30 and die 32 at the embossing station, preferably selected to be the top position of travel of the wheels 22 and 24. Referring to FIG. 2, when the intermediate drivers 75 and 82 are in a retracted position there is sufficient clearance between the intermediate drivers 75 and 82 and the punch 30 and die 32, so that the wheels 22 and 24 can freely rotate. A transport mechanism positions a card 20 intermediate the punch 30 and die 32, for presenting at the embossing station, each location on that card which is to be embossed by the character corresponding to the given pair of punch 30 and die 32 currently positioned at the embossing station. As before noted, continuous rotation of the cam 34 causes the bail arms 36 and 38 to continuously oscillate about their respective pivotal mounts. When the desired character of the punch and die pair is at the embossing station and the card 20 is suitably positioned to receive that embossed character at the location of the card then present between the punch and die 30 and 32, the interposer solenoids 52 and 71 are energized thereby to dispose their corresponding interposer tips (e.g. the interposer tip 54 associated with interposer solenoid 52 as shown in FIG. 2) intermediate the driving surface 56a of the bracket 56 and the engaging end 75a of the intermediate driver 75. The timing for energization of the solenoids 42 and 52 is selected such that the corresponding interposer tips, e.g. the interposer tip 54, are disposed in that position at the beginning of an embossing cycle, and thus when the bail arm 36 is in its rearwardly disposed position and not in its most clockwise direction of motion generally corresponding to the position shown in FIG. 2. In FIG. 2, the space between the interposer tip 54 and the engaging end 75a of the intermediate driver 75 is exaggerated for clarity of illustration. In fact, only sufficient space is provided to enable the requisite travel of the tip 54. Similarly, the spacing between the driver 75 and the punch 30 is exaggerated.

As later described herein, when the interposers are engaged and during that portion of the embossing cycle wherein the cam 34 drives the bail arm 36 in a counterclockwise direction and drives the bail arm 38 in a clockwise direction, the interposer tips are driven through their corresponding brackets 56 and 72 by their associated bail arms 36 and 38, to engage and drive the corresponding intermediate drivers 75 and 82 and in turn the associated punch and die 30 and 32 toward the associated surfaces of the card 20 to emboss the card with the desired character. As the cam 34 continues its rotation, the bail arms 36 and 38 move in their respectively opposite pivotal direction, the intermediate drivers 75 and 82 are returned to their rest position by spring bias (in the case of driver 75, by its bias spring 78), the retractors 84 and 86 retract the punch and die 30 and 32, and when the pressure is released, by suitably timing, the solenoids 52 and 71 are de-energized and the associated interposer tips (e.g., interposer tip 54 associated with solenoid 52) are withdrawn. If the interposer tips are withdrawn, i.e., when in a rest position, the forward movement of the brackets 56 and 72, produced by the continuous oscillation of the bail arms 36 and 38, is not of sufficient extent to engage the intermediate drivers 75 and 82. Thus, the punch and die wheels 22 and 24 are free to rotate to position a next successive punch and die pair at the embossing station.

The bail arms 36 and 39 continuously oscillate and thus could provide an embossing operation during each oscillation interval. However, an embossing operation is performed only if the card 20 is properly positioned for being embossed by a desired punch and die pair positioned at the embossing station by selective rotation of the wheels 22 and 24. Therefore, the solenoid-actuated interposers 52 and 71 are selectively energized to insert, or interpose, their corresponding tips into the embossing drive train during an embossing cycle following the proper positioning of the card 20 and the desired, or selected, punch and die pair at the embossing station. The particular circuitry and control system for selectively actuating the solenoid interposers 52 and 71 is described in U. S. Pat. No. 4,088,216.

Figure 5:
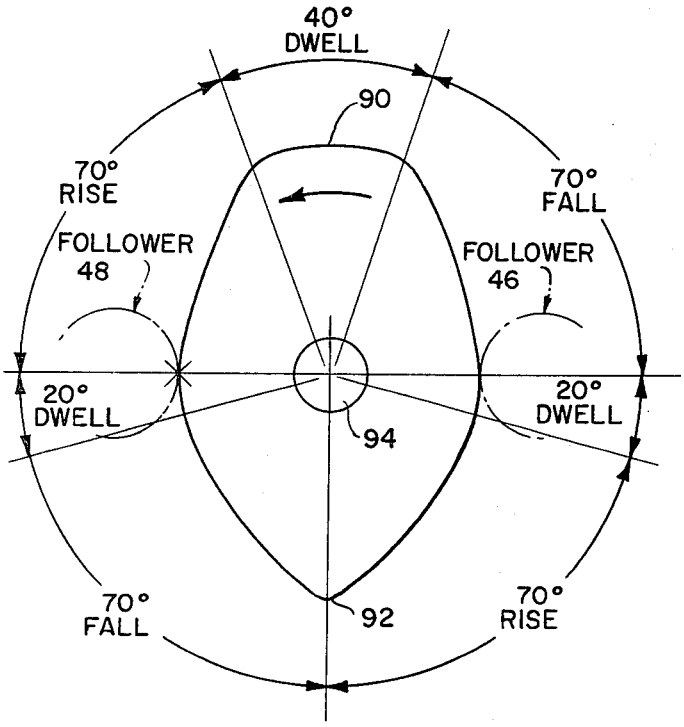
FIG. 5 illustrates an embodiment of the drive cam.

As is apparent, the shape of cam 34 controls the motion of the respective bails arms 37 and 38 and thus may be selected to provide various desired types of embossing characteristics. A preferred such characteristic is defined by first positioning the die 32 against the front surface of card 20 as seen in FIG. 2 and then maintaining die 32 stationary while punch 30 is driven in a reciprocating motion, both into the card 20 from the rear and then retracted, following which, die 32 is retracted. A preferred surface or shape of cam 34 for achieving this sequence of operations is illustrated in FIG. 5. For reference purposes, the cam 34 is identified as having lobes 90 and 92 and is shown to include a central aperture 94 for receiving the shaft 51 to which the cam 34 is securely affixed to be rotated thereby.

Figure 6:
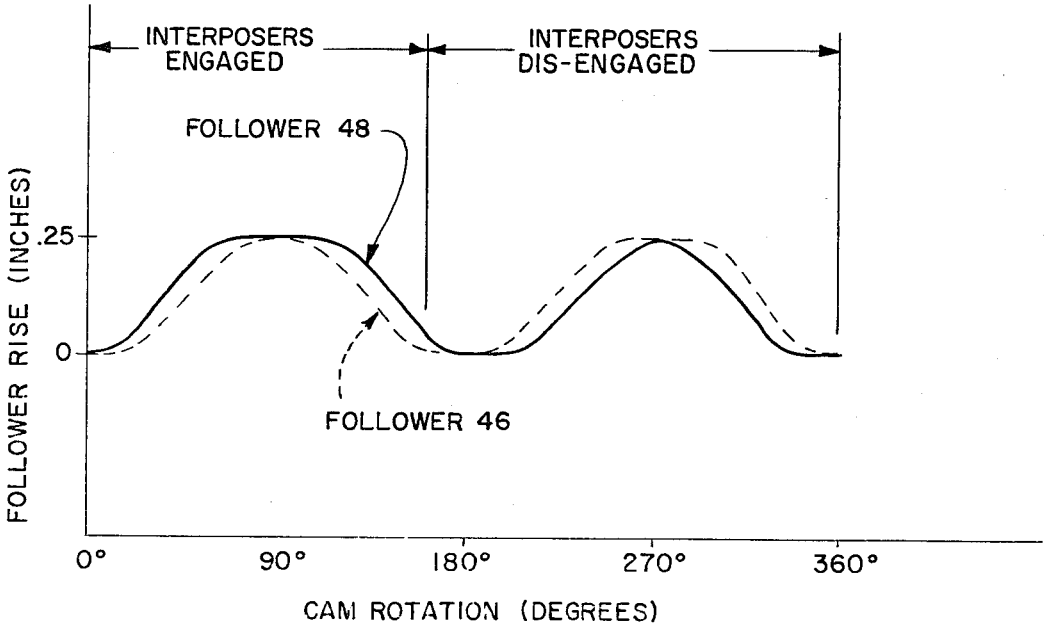
FIG. 6 is a graph illustrating the rise and fall of the cam followers as a function of cam rotation.

With reference to FIGS. 5 and 6, each complete revolution of the cam 34 defines an embossing cycle. The movement of the followers 46 and 48 and the corresponding engaged and disengaged conditions of the interposers in an embossing cycle in which an embossing operation is caused to occur are illustrated in FIG. 6. As seen therein the extent of the rise afforded by the cam 34 is a maximum of 0.25 inch. The initiation of a cycle is defined with the cam 34 in the position shown in FIG. 5 and with the follower 48 engaging the cam surface at point X, as shown in FIG. 5.

Cam Rotation From 0° (X) to 70°

As the cam rotates from 0° to 70°, the follower 48 rises from its nominal, or minimum "0" level to its predetermined maximum travel, or height, of 0.25 inch. During this same 70° of rotation, the follower 46 initially dwells at its "0" level for 20°, and then begins its rise.

Cam Rotation From 70° to 110°

As the cam 34 continues to rotate, the follower 48 dwells for 40° (from 70° to 110°) while the follower 46 completes its predetermined amount of rise to 0.25 inch (70° to 90°) and then begins to fall (90° to 110°). If the interposer tips have been actuated (generally done at 0° or shortly thereafter, prior to any significant amount of rise of the corresponding followers), embossing occurs during the interval preceding and following the 90° cam position, in which both followers 46 and 48 have risen to their maximum pre-determined height.

Cam Rotation From 110° to 180°

Follower 46 continues its fall to 0.0 inch (110° to 160°) and then has a 20° dwell (160° to 180°). Follower 48 falls through the full 0.25 inch travel during this 70° cam rotation (110° to 180°). At this point the cam 34 has completed 180° of rotation.

Cam Rotation From 180° to 360° (X)

For the final 180° of cam rotation, the follower 46 follows the motion described above for the follower 48 and the follower 48 follows the motion described above for the follower 46 for the first 180° of rotation. During this second 180° of rotation (180° to 360°) a photodetector 88 (FIG. 3) detects the position of the cam 34 and generates a signal for the control circuitry to disable actuation of the interposer solenoids. This corresponds to the portion of the graph in FIG. 6 which is marked "INTERPOSERS DISENGAGED".

From the above, it can be seen that a cam shape such as that illustrated in FIG. 5 achieves the desired sequence of operations. That is, the follower 48 reaches its maximum rise after 70° of cam rotation and then dwells at this point for 40°. Thus, if the interposer tips have been actuated, die 32 is positioned against card 20 for a 40° dwell. During this 40° dwell the follower 46 continues to rise, reaches its maximum height (at which time punch 30 is pushed its maximum extent into card 20) and thereafter begins to fall away, so that punch 30 is retracted from card 20. Then the die 32 falls away.

As noted above, the photodetector 88 detects the cam 34 and generates a signal which is used to prevent embossing during the second 180° of cam rotation.

Referring to FIG. 6, when the solid line (representing the position of cam follower 48) is at its maximum height, the die is in the embossing position. Similarly, when the dotted line (representing the position of cam follower 46) is at its maximum height, the punch is in the embossing position. In the desired sequence of operation, the die is moved into the embossing position first and then the punch is moved into the embossing position. This corresponds to the rotation of the cam 34 from 0° to 180° (INTERPOSERS ENGAGED). During the second 180° of rotation of the cam 34, if the interposers were engaged, the punch 32 would be moved into the embossing position first (dotted line) and then the die would be moved into and out of the embossing position (solid line) while the punch remained in the embossing position. Since this sequence of punch and die movement is the opposite of the desired sequence, the photodetector 88 is employed to generate a signal which is used to disable the interposer solenoids during this second 180° of cam rotation.

The adjustable mounting of the interposer structures 40 and 42 on bail arms 36 and 38 greatly facilitates initial alignment procedures for achieving the described, desired embossing operation. The interposer structure 40 is adjusted first, with the interposer tip associated with interposer solenoid 71 in its engaged position for embossing, so that die 32 contacts the surface of the card 20 in its nominal, central position. Then, the interposer structure 42 is adjusted so that the corresponding travel of the punch achieves the desired embossing height on card 20.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A drive mechanism for actuating a die element carried by a die wheel and a punch element carried by a punch wheel to emboss a document positioned between the punch element and the die element, comprising:

a cam;

means for driving said cam in constant rotation;

a first bail arm mounted for pivotal movement in a plane transverse to said die wheel;

a second bail arm mounted for pivotal movement in a plane transverse to said punch wheel;

first and second cam followers, mounted on said first and second bail arms, respectively, said first and second cam followers biased in rolling contact with said cam and driven by rotation of said cam for in turn driving said first and second bail arms in complementary oscillatory movement;

first interposer means adjustably mounted on said first bail arm and selectively actuable to be disposed between said first bail arm and the die element;

second interposer means adjustably mounted on said second bail arm and selectively actuable to be disposed between said second bail arm and the punch element;

said first and second interposer means driving the corresponding die and punch elements into and out of engagement with the document for embossing the document in response to the complementary oscillatory movement of said first and second bail arms, said first and second interposer means being adjustable relative to said first and second bail arms, respectively, to achieve a desired embossing height on the document.

2. A drive mechanism as set forth in claim 1, wherein said cam is a two lobed cam.

3. A drive mechanism as set forth in claim 2, wherein said cam followers engage said cam at substantially 180° spaced-apart positions, and wherein said cam is a two lobed cam and is shaped to produce, in a first 180° of revolution thereof, complementary travel of said first and second cam followers and corresponding said complementary oscillatory movement of said first and second bail arms for initially driving said die element forward to engage the adjacent surface of the document and dwell at that position and thereafter drive said punch element forward to engage and emboss the document and then retract from the document, said die element thereafter retracting from the document.

4. A drive mechanism as set forth in claim 3, wherein said two lobed cam is shaped such that a complete 360° revolution of said two lobed cam produces a 70° rise, a 40° dwell, a 70° fall, a 20° dwell, a 70° rise, a 70° fall, and a 20° dwell.

5. A drive mechanism as set forth in claim 1, wherein said first interposer means comprises:

a first interposer bracket adjustably mounted on the end of said first bail arm; and a first interposer solenoid, carrying an interposer tip on its movable core, mounted on said first interposer bracket, said first interposer bracket being adjustable relative to said first bail arm to achieve the desired embossing height on the document; and wherein said second interposer means comprises:

a second interposer bracket adjustably mounted on the end of said second bail arm; and a second interposer solenoid, carrying an interposer tip on its movable core, said second interposer bracket being adjustable relative to said second bail arm to achieve the desired embossing height on the document.

6. A drive mechanism as set forth in claim 1, wherein the document to be embossed is a metal card.

7. A drive mechanism for selectively actuating one of a plurality of associated pairs of first and second embossing elements, said plurality of associated pairs of first and second embossing elements carried by first and second embossing element carriers, said apparatus for embossing a document positioned between the selected one of the plurality of associated pairs of first and second embossing elements, comprising:

a cam;

means for driving said cam in constant rotation;

first and second bail arms mounted for pivotal movement in a plane transverse to said first and second embossing element carriers;

first and second cam followers, mounted on said first and second bail arms, respectively, and biased in rolling contact with said cam and driven by rotation of said cam for in turn driving said first and second bail arms in complementary oscillatory movement;

first interposer means adjustably mounted on said first bail arm and selectively actuable to be disposed between said first bail arm and the selected first embossing element; and second interposer means adjustably mounted on said second bail arm and selectively actuable to be disposed between said second bail arm and the selected second embossing element;

said first and second interposer means driving the selected pair of first and second embossing elements into and out of engagement with the document for embossing the document in response to the complementary oscillatory movement of said first and second bail arms, said first and second interposer means being adjustable relative to said first and second bail arms, respectively, to achieve a desired embossing height on the document.

8. A drive mechanism as set forth in claim 7, wherein said first interposer means comprises:

a first interposer bracket adjustably mounted on the end of said first bail arm; and a first interposer solenoid, carrying an interposer tip on its movable core, mounted on said first interposer bracket, said first interposer bracket being adjustable relative to said first bail arm to achieve the desired embossing height on the document; and wherein said second interposer means comprises:

a second interposer bracket adjustably mounted on the end of said second bail arm; and a second interposer solenoid carrying an interposer tip on its movable core, said second interposer bracket being adjustable relative to said second bail arm to achieve the desired embossing height on the document.

9. A drive mechanism as set forth in claim 7 or 8 wherein said cam is a two lobed cam.

10. A drive mechanism as set forth in claim 9, wherein said cam followers engage said cam at substantially 180° spaced-apart positions, and wherein said cam is a two lobed cam and is shaped to produce, in a first 180° of revolution thereof, complementary travel of said first and second cam followers and corresponding said complementary oscillatory movement of said first and second bail arms for initially driving said first embossing element forward to engage the adjacent surface of the document and dwell at that position and thereafter to drive said second embossing element forward to engage and emboss the document and then retract from the document, said first embossing element thereafter retracting from the document.

11. A drive mechanism as set forth in claim 9, wherein said two lobed cam is shaped such that a complete 360° revolution of said two lobed cam produces a 70° rise, a 40° dwell, a 70° fall, a 20° dwell, a 70° rise, a 70° fall, and a 20° dwell.

12. A drive mechanism as set forth in claim 7, wherein the document to be embossed is a metal card.

13. A drive mechanism for selectively actuating one of a plurality of die elements carried by a die wheel and one of a plurality of punch elements carried by a punch wheel to emboss a document positioned between the selected punch and die elements, comprising:

a cam;

means for driving said cam in constant rotation;

a first bail arm mounted for pivotal movement in a plane transverse to the die wheel;

a second bail arm mounted for pivotal movement in a plane transverse to the punch wheel;

first and second cam followers, mounted on said first and second bail arms, respectively, said first and second cam followers biased in rolling contact with said cam and driven by rotation of said cam for in turn driving said first and second bail arms in complementary oscillatory movement;

first interposer means adjustably mounted on said first bail arm and selectively actuable to be disposed between said first bail arm and the selected die element;

second interposer means adjustably mounted on said second bail arm and selectively actuable to be disposed between said second bail arm and the selected punch element;

said first and second interposer means driving the selected die and punch elements, respectively, into and out of engagement with the document for embossing the document in response to the complementary oscillatory movement of said first and second bail arms, said first and second interposer means being adjustable relative to said first and second bail arms, respectively, to achieve a desired embossing height on the document.

14. A drive mechanism as set forth in claim 13, wherein said first interposer means comprises:

a first interposer bracket adjustably mounted on the end of said first bail arm; and a first interposer solenoid, carrying an interposer tip on its movable core, mounted on said first interposer bracket, said first interposer bracket being adjustable relative to said first bail arm to achieve the desired embossing height on the document, and wherein said second interposer means comprises:

a second interposer bracket adjustably mounted on the end of said bail arm; and a second interposer solenoid, carrying an interposer tip on its movable core, mounted on said second interposer bracket, said second interposer bracket being adjustable relative to said second bail arm to achieve the desired embossing height on the document.

15. A drive mechanism as set forth in claim 14, further comprising:

a first intermediate driver mounted between the die element and the interposer tip of the first interposer solenoid, for transmitting the driving force of said first bail arm to the die element; and a second intermediate driver mounted between the punch element and the interposer tip of said second interposer solenoid, for transmitting the driving force of said second bail arm to the punch element.

16. A drive mechanism as set forth in claim 13 or 14 wherein said cam is a two lobed cam.

17. A drive mechanism as set forth in claim 16, wherein said cam followers engage said cam at substantially 180° spaced-apart positions, and wherein said cam is a two lobed cam and is shaped to produce, in a first 180° revolution thereof, complementary travel of said first and second cam followers and corresponding said complementary oscillatory movement of said bail arms for initially driving said die element forward to engage the adjacent surface of the document and dwell at that position and thereafter to drive said punch element forward to engage and emboss the document and then retract from the document, said die element thereafter retracting from the document.

18. A drive mechanism as set forth in claim 13, wherein the document to be embossed is a metal card.

* * * * *

UNITED STATES PATENT AND TRADEMARK OFFICE

CERTIFICATE OF CORRECTION

PATENT NO. : 4,378,733

DATED : APRIL 5, 1983

INVENTOR(S) : MICHAEL D. POLAD

It is certified that error appears in the above-identified patent and that said Letters Patent is hereby corrected as shown below:

Column 5, line 60, "bails" should be --bail--; and "37" should be --36.

Signed and Sealed this

*Twenty-third* Day of *August 1983*

[SEAL]

*Attest:*

GERALD J. MOSSINGHOFF

*Attesting Officer*

*Commissioner of Patents and Trademarks*